US012441534B2

(12) United States Patent
Bauer et al.

(10) Patent No.: US 12,441,534 B2
(45) Date of Patent: Oct. 14, 2025

(54) MOISTURE-PERMEABLE, MICROPOROUS LUXURY FOOD PACKAGING MATERIAL MADE OF NONWOVEN FABRIC

(71) Applicant: TENOWO GMBH, Hof (DE)

(72) Inventors: Mirko Bauer, Chemnitz (DE); Brandon Ratcliffe, Newton, NC (US); Jan Maidorn, Bayreuth (DE)

(73) Assignee: TENOWO GMBH, Hof (DE)

( * ) Notice: Subject to any disclaimer, the term of this patent is extended or adjusted under 35 U.S.C. 154(b) by 123 days.

(21) Appl. No.: 18/015,556

(22) PCT Filed: Jul. 27, 2021

(86) PCT No.: PCT/EP2021/070960
§ 371 (c)(1),
(2) Date: Jan. 11, 2023

(87) PCT Pub. No.: WO2022/023318
PCT Pub. Date: Feb. 3, 2022

(65) Prior Publication Data

US 2023/0249899 A1 Aug. 10, 2023

(30) Foreign Application Priority Data

Jul. 30, 2020 (DE) ..... 102020120138.9
Sep. 11, 2020 (DE) ..... 102020123688.3

(51) Int. Cl.
*B65D 85/804* (2006.01)
*D04H 1/64* (2012.01)
*D04H 1/70* (2012.01)

(52) U.S. Cl.
CPC ..... *B65D 85/8043* (2013.01); *D04H 1/64* (2013.01); *D04H 1/70* (2013.01); *D10B 2505/10* (2013.01)

(58) Field of Classification Search
CPC ..... B65D 85/8043; D04H 1/64; D04H 1/70
(Continued)

(56) References Cited

U.S. PATENT DOCUMENTS

2008/0302682 A1 12/2008 Engstrom et al. ..... 206/260
2011/0139166 A1 6/2011 Luzenberg, Jr. ..... 131/359
(Continued)

FOREIGN PATENT DOCUMENTS

DE 202015102564 U1 8/2015 ..... B65D 30/02
EP 1873289 A1 * 1/2008 ..... D04H 1/425
(Continued)

OTHER PUBLICATIONS

Notification Concerning Transmittal of International Preliminary Report on Patentability (Chapter I of the Patent Cooperation Treaty), in English, dated Feb. 9, 2023, which was issued by the International Bureau of WIPO in Applicant's corresponding international PCT application having Serial No. PCT/EP2021/070960, filed on Jul. 27, 2021.
(Continued)

*Primary Examiner* — Tahseen Khan
(74) *Attorney, Agent, or Firm* — Bodner & Bodner, PLLC; Gerald T. Bodner; Christian P. Bodner

(57) ABSTRACT

The invention relates to moisture-permeable, microporous luxury food packaging material made of nonwoven fabric, consisting of a carded web of staple fibres and at least one thermoplastic binder. According to the invention the nonwoven fabric has a uniformly distributed perforation in the form of a plurality of holes, the fluctuation around the median value of the diameter of the holes being in the region of +/−30%. In the method according to the invention the perforation is formed by creating holes by means of piercing the pre-bonded nonwoven fabric.

18 Claims, 3 Drawing Sheets

Figure 1:
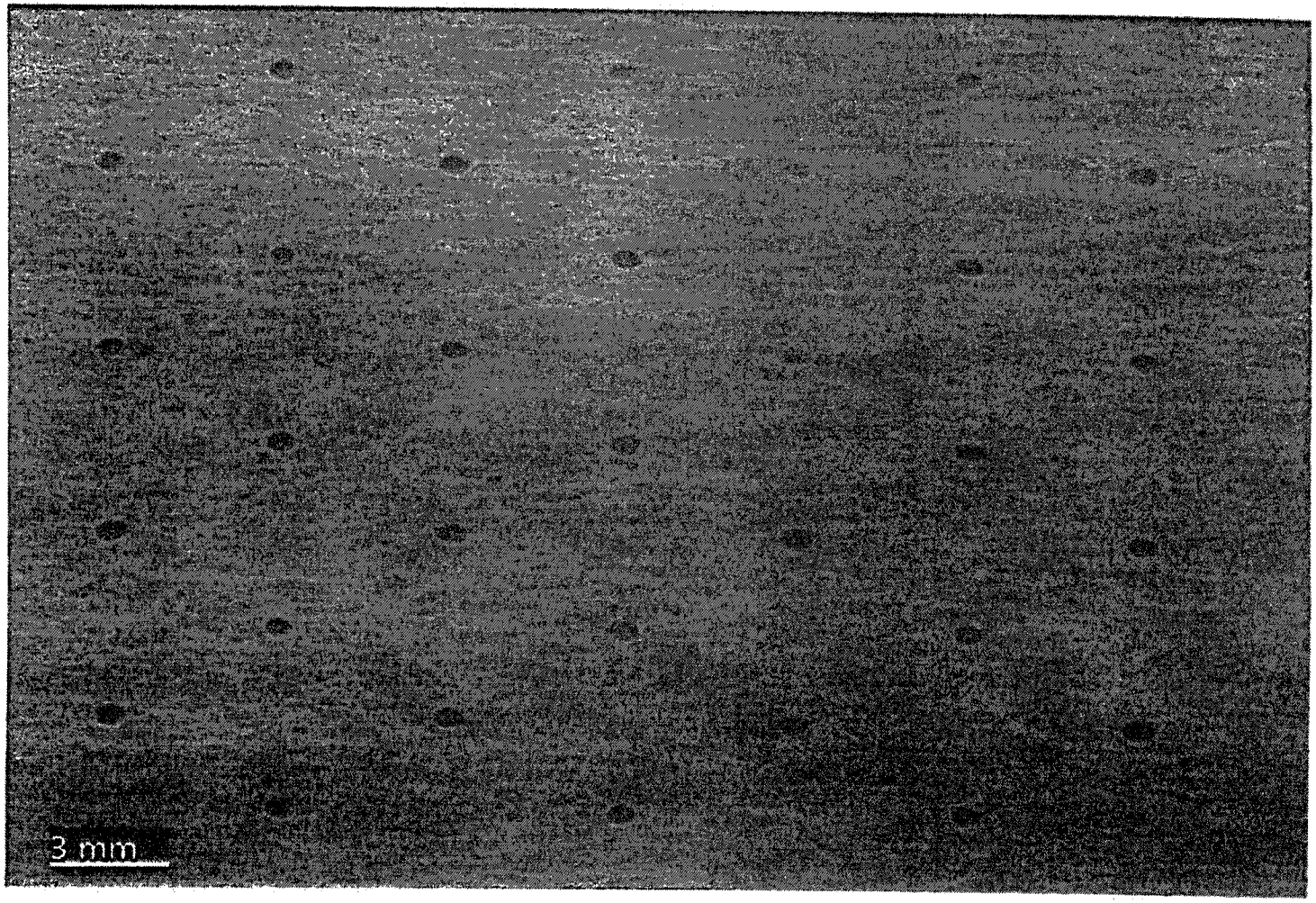

(58) Field of Classification Search
USPC ..... 428/134
See application file for complete search history.

(56) References Cited

U.S. PATENT DOCUMENTS

| | | | | |
|---|---|---|---|---|
| 2012/0178331 | A1* | 7/2012 | Gupta | D21H 15/06 442/337 |
| 2014/0026912 | A1* | 1/2014 | Rushforth | A24B 13/00 131/352 |
| 2014/0261473 | A1 | 9/2014 | Carroll et al. | 131/118 |
| 2016/0157515 | A1* | 6/2016 | Chapman | A61K 9/009 131/352 |

FOREIGN PATENT DOCUMENTS

| | | | | |
|---|---|---|---|---|
| EP | 2138056 | A2 * | 12/2009 | B65D 65/38 |
| EP | 3192380 | A1 | 7/2017 | A24B 13/00 |
| EP | 2138056 | B1 | 8/2018 | A24B 13/00 |
| EP | 2692254 | B1 | 3/2019 | A24B 13/00 |
| WO | WO2012061192 | A1 | 5/2012 | A24B 13/00 |

OTHER PUBLICATIONS

English translation of the International Preliminary Report on Patentability (Chapter I of the Patent Cooperation Treaty), dated Jan. 31, 2023, which was issued by the International Bureau of WIPO in Applicant's corresponding international PCT application having Serial No. PCT/EP2021/070960, filed on Jul. 27, 2021.

Written Opinion of the International Searching Authority, in English, dated Feb. 4, 2022, which was issued by the International Bureau of WIPO in Applicant's corresponding international PCT application having Serial No. PCT/EP2021/070960, filed on Jul. 27, 2021.

International Search Report, in English, dated Feb. 4, 2022, which was issued by the International Bureau of WIPO in Applicant's corresponding international PCT application having Serial No. PCT/EP2021/070960, filed on Jul. 27, 2021.

Search Report (in German), dated May 4, 2021, issued by the German Patent Office for Applicant's corresponding German Patent Application No. DE102020123688.3, filed Sep. 11, 2020.

Office Action (in German), dated Feb. 6, 2024, issued by the European Patent Office for Applicant's related European Patent Application No. EP21758318.6.

* cited by examiner

MOISTURE-PERMEABLE, MICROPOROUS LUXURY FOOD PACKAGING MATERIAL MADE OF NONWOVEN FABRIC

The invention relates to a moisture-permeable, microporous luxury food packaging material made of non-woven fabric, consisting of a carded web of staple fibres and at least one thermoplastic binder according to the preamble of claim 1, as well as to a method for producing such a luxury food packaging material according to claim 11.

Packaging materials for solid luxury foods for oral application have been known for quite a long time. In this respect, bag-like structures are filled with aroma-containing particles and/or active agent-containing particles, vegetal material or similar. Here, teat, coffee, impregnated coconut fibres, tobacco or similar are used, for example. The filled bags are placed in the mouth, whereby, due to the salivation, the aroma materials and/or active agents can be extracted and absorbed.

For such packaging materials, non-woven binding fabrics are widespread. The contain a high proportion of a thermoplastic binder, which can amount up to 50%.

As far as the producer is concerned, a carded web of staple fibres is impregnated with a foamed polymer dispersion and subsequently dried.

In order to enable the thermal welding of the non-woven fabric in a bag-like form, the polymer dispersion consists at least in part of a thermoplastic polymer and/or the fibre mixture contains fibres of thermoplastic material.

A disadvantage is that the pores inherently present within the non-woven fabric result from a random distribution of the fibres, which causes a broad variance of the pores in their shapes and sizes. In this respect, reference is made to US 2008/0302682 A1 or US 2011/0139166 A1 and the materials disclosed there.

EP 2 138 056 B1 also shows a non-woven fabric for use as a moisture-permeable, microporous luxury food packaging material. The non-woven fabric described there consists of a basic non-woven fabric of viscose fibres pre-strengthened by means of a water jet, and meltable fibres of a thermoplastic polymer material.

Due to the pre-strengthening by means of a water jet, the von-woven fabric to the produced disposes of the required porosity for use as a packaging material, in particular for oral tobacco, and is on the other hand more abrasion-resistant and more cost efficient than hitherto used packaging materials. The already known non-woven fabric has a surface weight of 25 g/m$^2$ and consists of a fibre material prepared from 70% of viscous fibres and 30% of polypropylene fibres.

From EP 2 692 254 B1, a non-woven fabric for smoke-free tobacco is already known. The non-woven fabric there is provided with openings, wherein the medium opening size is at least 50 μm in diameter. The non-woven fabric itself is strengthened by a water jet, wherein the mentioned openings or holes in the non-woven fabric are generated during strengthening. These holes serve for the better transport of aroma or active agents all throughout the non-woven fabric material.

In EP 2 692 254 B1, it is presented in detail as being disadvantageous that the formation and shape of the holes result in different mechanical properties of the non-woven fabric material in particular with respect to tensile strength.

When holes are formed during the water jet strengthening, the difficulty arises to create holes of a uniform sizes having a low spread width. Too large holes lead to an undesired penetration of particles absorbed within the packaging material. Too small holes impede the necessary liquid transport when the substances contained within the packaging material are consumed.

So as to solve the problem of the rapid intake, for example, of nicotine in oral tobacco having a tobacco composition within a bag of non-woven fabric, DE 20 2015 102 564 U1 proposes to refer to a non-woven fabric made of fibres of lyocell. In this case, the fibres should be free from titanium dioxide. Such fibres are more permeable for the juice exiting the tobacco material when the tobacco bag is placed within the oral cavity.

From the aforementioned, it is a task of the invention to propose a further developed, moisture-permeable, microporous luxury food packaging material on the basis of a non-woven material and a corresponding method which allows the absorption capacity of quite different consumptions goods present within the packaging to be improved, and namely on the basis of an optimized and adaptable perforation of the non-woven fabric.

The solution of the task of the invention is performed by a moisture-permeable, microporous luxury food packaging material of non-woven fabric according to the teaching of claims 1, as well as a method for producing such a luxury food packaging material according to claim 11, wherein the subclaims include at least appropriate configurations and further developments.

The moisture-permeable, microporous luxury food packaging material of non-woven fabric is based on a material consisting of a carded web of staple fibres and at least one thermoplastic binder.

According to the invention, the non-woven fabric has a uniformly distributed perforation in the form of a plurality of holes, the fluctuation around the median value of the diameter being in the range of +/−30%.

The non-woven fabric itself is chemically strengthened, in particular by means of a polymer dispersion.

At least 95% of the equivalent diameter of the holed is in the range of +/−30% of the median value mentioned above.

The median of the equivalent diameter of the holes is in the range from between 250 to 1000 μm, preferably in the range from between 500 to 750 μm.

Furthermore, according to the invention, the position of the fibres in the region of the holes is reoriented.

In particular, at the edge of the holes, the fibres have an orientation resulting in a funnel shape to be formed.

The funnel shape may protrude beyond the non-woven fabric surface.

The holes themselves preferably have a circular up to oval structure but can also adopt the form of a rhombus, a square or a triangle or polygon.

According to the invention, the holes are formed to have a sharp contour that is free from fibre ends or fibre tips.

The median of the equivalent diameters of the holes may be adapted to the respective luxury food to be enclosed.

In the method for producing the moisture-permeable, microporous luxury food packaging material of non-woven fabric, the non-woven fabric pre-strengthened in a manner known per se is subjected to a perforation treatment by means of piercing.

For Piercing, preferably needles are used displacing the non-woven fabric fibres in the non-woven fabric material for forming the holes.

According to the invention, the needles can be heated at least during the piercing process such that the thermoplastic binder at least partially melts or softens at the contact points to the needle, resulting in a hole formation having a sharp and reproducible contour during cooling down.

With the penetration of the needles into the non-woven fabric, parts of the fibres are displaced along the direction of movement of the needles.

Thus, the needles may cause the fibres to be reorientated while forming a funnel-like-structure, wherein the funnel forms from the exit point of the needles from the non-woven fabric to the surface side there.

The penetration density of the needles and thus the number of holes is selectable in the range from between 4 to 50 holes per $cm^2$.

According to the invention, an appropriate original non-woven fabric, preferably a binder non-woven fabric, is subjected subsequently to the desired perforation for forming holes by means of piercing needles.

While doing that, it was found that on the basis of the perforating means of needles, holes can be generated having a significantly more uniform size than it is the case in using the water jet technology.

The fluctuation about the median of the diameter according to the invention preferably is in the range of +/−30%.

In the selected technology, there is the possibility to perforate even binder non-woven fabrics, i.e. non-woven fabrics strengthened chemically by means of binders. The advantage of using binder non-woven fabrics is that these can be better welded due to the higher proportion of thermoplastic binders than water jet-strengthened non-woven fabrics.

But it is likewise possible to perforate mechanically or thermally strengthened non-woven fabrics subsequently by means of needles.

Suited for use are in particular chemically strengthened non-woven fabrics for oral packs having a parallel-laid fibrous web and a surface weight from essentially 25 to 35 $g/m^2$.

In an embodiment according to the invention, the needles used for perforating are heated so that the thermoplastic binder contained within the non-woven fabric is at least partially softened or molten at the contact point to the needle.

With the binder cooling down, the fibres are then fixed in their positions resulting in a sharper and more delimitable structure or contour of the holes. Furthermore, the dimensional stability of the holes is improved by this measure so that these, for example, are deformed much less by tensile forces, occurring in the subsequent process steps. Hereby, the disadvantage of the state of the art depicted at the beginning is achieved to be avoided with respect to dimensional stability in different areal directions.

The heating of the needles may be performed electrically, by blowing on hot air or in another appropriate way.

For the technological control, the hole size may be determined by a graphic evaluation.

For example, a photographic or microscopic image of the treated material is made. By means of a digital image processing software, the contour of the holes can be recognized in an automated way on the basis of an appropriate threshold value and the surface area thereof may be determined. From the surface area of the holes, the equivalent diameter is in each case calculated which corresponds to a circle having the same surface.

The median of the equivalent diameters of the holes can in each case be adapted to the respective filler material and is preferably in the region from 250 to 1000 μm, and in particular preferably in the region between 500 up to 750 μm.

As explained in the claims, the diameter of a plurality of holes according to the invention only has a very low variance. It has been found to be particularly advantageous if at least 95% of the measured values are in a region of +/−30% around the median value of the diameter.

With respect to the very low spread according to the invention of the hole size, the average diameter thereof can be enlarged relative to the state of the art without the risk of too large holes developing through which the solid filler material contained within the respective packages or bags can exit.

Due to the larger average diameter in turn, the distribution and transport of aroma substances or corresponding active agents solved within the storage are improved.

Due to the needles penetrating into the two-dimensional non-woven fabric, some fibres are reoriented along the direction of movement of the piercing needles. These fibres follow the direction of movement of the needles which results in a funnel-shaped form. Corresponding reoriented fibres then protrude in a funnel-shape beyond the non-woven fabric surface.

Due to these fibres oriented quasi perpendicularly to the surface, the liquid transport is improved in this direction.

That means that, when the funnel-shaped elevations are arranged on the inner side of the later packaging bags, saliva may get faster into the interior of the bag along the perpendicularly oriented fibres, and moisten faster the enclosed material there, which leads to a quicker release of the ingredients.

An alternative to the use of needles is to execute the perforation by means of a hot gas jet generated by a nozzle arrangement in a targeted way. Also in this case, the result is that the fibres are partially molten while forming dimension-stable holes as explained before.

The invention will be explained hereinafter on the basis of an exemplary embodiment as well as of Figures.

Figure 2:
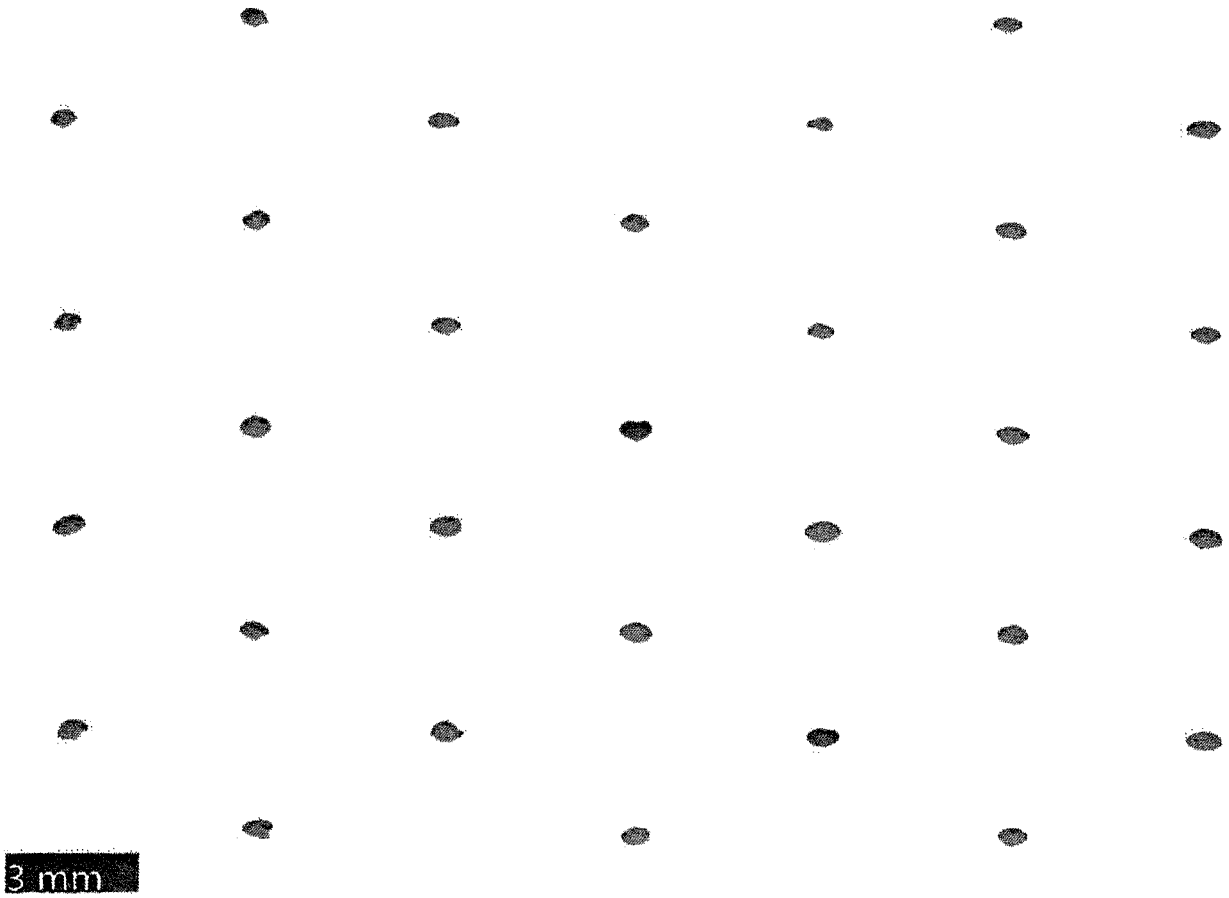
Figure 3:
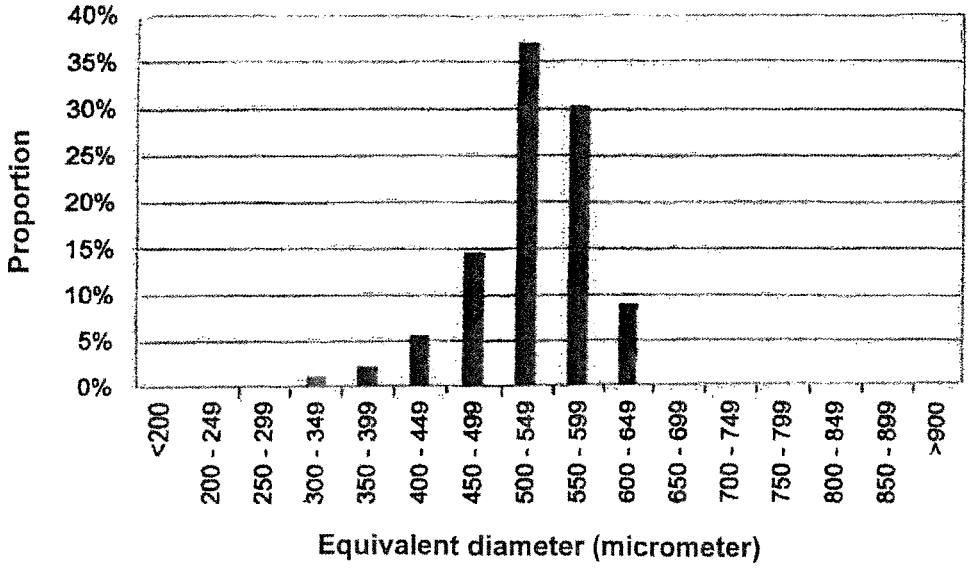

Shown are in:

FIG. 1 an exemplary embodiment in the form of a view onto a non-woven fabric with holes created by needles, as a microscopically made enlarged image;

FIG. 2 an identified and quantitatively evaluated hole arrangement in analogy to the image section according to FIG. 1; and FIG. 3 an exemplary frequency distribution of the equivalent diameter of the perforations.

In the exemplary embodiment, a parallel-laid carded web of 100% viscose fibres in a fineness of 1.7 dtex is chemically strengthened in a first step by means of a dispersion of a thermoplastic polyacrylate having a softening point of 115° C. The thus created binder non-woven fabric has a surface weight of 26 $g/m^2$.

In the second step, the non-woven fabric is pierced and perforated by means of hot needles.

The needles have a temperature of ≥130° C. so that the thermoplastic polyacrylate at the piercing points becomes deformable.

The selected exemplary piercing density is at 4.65 per $cm^2$. The mechanical properties such as, for example, the maximum tensile force and maximum tensile force elongation surprisingly remain unchanged relative to the initial material.

For determining the hole size, microscopic images with a 100-fold enlargement were made at several points.

A subsequent evaluation by means of an image processing software firstly converts the image into grey scales. By means of a threshold value, the automatic recognition of the position and size of the holes, as well as the calculation of the surface area thereof is performed subsequently by the software used.

From the thus obtained surface area, the equivalent diameter is in each case calculated. The evaluation of the measured values resulted in a median of the equivalent diameter of 536 μm.

99% of the measured values are in a range of +/−30% around the median, thus in the range from 375 to 697 μm, as is illustrated by FIG. 3.

96% of the measured values are in a range of +/−20% around the median, thus in the range from 429 to 643 μm.

The frequency distribution of the equivalent diameters illustrated in FIG. 3 comprises the evaluation of several areas as illustrated in FIGS. 1 and 2.

The invention claimed is:

1. A moisture-permeable, microporous luxury food packaging material made of non-woven fabric, consisting of a carded web of staple fibres and at least one thermoplastic binder, characterized in that the non-woven fabric has a uniformly distributed perforation in the form of a plurality of holes, wherein the holes have equivalent diameters and at least 99% of the equivalent diameters of the holes have a fluctuation around a median value of the equivalent diameters of the holes which is in the range of +/−30% of the median value.

2. The moisture-permeable, microporous luxury food packaging material according to claim 1, characterized in that the non-woven fabric is chemically strengthened, in particular by means of a polymer dispersion.

3. The moisture-permeable, microporous luxury food packaging material according to claim 1, characterized in that the median of the equivalent diameters of the holes is in the range from 250 to 1000 μm.

4. The moisture-permeable, microporous luxury food packaging material according to claim 1, characterized in that the holes have a circular structure, an oval structure or the shape of a polygon.

5. The moisture-permeable, microporous luxury food packaging material according to claim 1, characterized in that the holes have a sharp contour that is essentially free from fibre ends or fibre tips.

6. The moisture-permeable, microporous luxury food packaging material according to claim 1, characterized in that the median of the equivalent diameters of the holes is adapted to the respective luxury food to be enclosed by the food packaging material.

7. The moisture-permeable, microporous luxury food packaging material according to claim 1, characterized in that the median of the equivalent diameters of the holes is in the range from 500 to 750 μm.

8. The moisture-permeable, microporous luxury food packaging material according to claim 1, characterized in that the position of the fibres in the region of the holes has a reorientation.

9. The moisture-permeable, microporous luxury food packaging material according to claim 8, characterized in that each hole has an edge, and the fibres have an orientation at the edges of the holes resulting in a funnel-shape to be formed.

10. The moisture-permeable, microporous luxury food packaging material according to claim 9, characterized in that the funnel-shape protrudes beyond the non-woven fabric surface.

11. A method for producing a moisture-permeable, microporous luxury food packaging material made of non-woven fabric according to claim 1, characterized in that the non-woven fabric is subjected to a perforation treatment by means of piercing.

12. The method according to claim 11, characterized in that needles are used for the piercing process which displace the non-woven fabric fibres for forming the holes.

13. The method according to claim 12, characterized in that the needles are heated at least during the piercing process such that the thermoplastic binder at least partially softens at the contact points to the needle and adopts a deformable state, resulting in a hole formation having a sharp and reproducible contour during cooling down.

14. The method according to claim 13, characterized in that with the needles penetrating into the non-woven fabric, parts of the fibres are displaced along the direction of movement of the needles and reoriented.

15. The method according to claim 14, characterized in that the needles cause the fibres to be reorientated while forming a funnel-like structure, wherein the funnel forms from an exit point of the respective needle from the non-woven fabric to a surface side thereof.

16. The method according to claim 11, characterized in that a penetration density of the needles and thus the number of holes is selectable in the range from between 4 to 50 holes per $cm^2$.

17. A moisture-permeable, microporous luxury food packaging material made of non-woven fabric, consisting of a carded web of staple fibres and at least one thermoplastic binder, characterized in that the non-woven fabric has a uniformly distributed perforation in the form of a plurality of holes, wherein the fluctuation around the median value of the diameter of the holes is in the range of +/−30%;

wherein the position of the fibres in the region of the holes has a reorientation; and wherein the fibres have an orientation at the edge of the holes resulting in a funnel-shape to be formed.

18. The moisture-permeable, microporous luxury food packaging material according to claim 17, characterized in that the funnel-shape protrudes beyond the non-woven fabric surface.

* * * * *